United States Patent [19]

Brown

[11] 3,951,404

[45] Apr. 20, 1976

[54] EXERCISING DEVICE HAVING TUBULAR LENGTHS OF STRETCHABLE MATERIAL THE ENDS OF WHICH HAVE CONNECTING MEANS TO FORM THE LENGTHS INTO ENDLESS BANDS

[76] Inventor: Michael H. Brown, P.O. Box 206, Berea, Ky. 40403

[22] Filed: Jan. 15, 1975

[21] Appl. No.: 541,261

[52] U.S. Cl. ..... 272/142; 273/DIG. 5

[51] Int. Cl.[2] ..... A63B 23/00; A63B 23/04

[58] Field of Search ..... 272/82, 83 R, 79 R, 272/DIG. 4, 67; 190/57, 39; 285/DIG. 16, 397, 398; 128/127; 273/DIG. 5

[56] References Cited

UNITED STATES PATENTS

| | | | |
|---|---|---|---|
| 1,885,473 | 11/1932 | Pat | 272/82 |
| 1,926,518 | 9/1933 | Findley | 128/127 |
| 2,699,182 | 1/1955 | Baldridge | 285/397 X |
| 2,930,614 | 3/1960 | McIntosh | 272/82 |
| 3,152,820 | 10/1964 | Giampa et al. | 285/DIG. 16 |
| 3,815,904 | 6/1974 | Weiss et al. | 272/82 |

*Primary Examiner*—Richard C. Pinkham
*Assistant Examiner*—William R. Browne

[57] ABSTRACT

An exercising device is disclosed for building and toning body muscles. The device has two substantially U-shaped frame members between which are looped bands of an elastometric material. Grips are provided between the ends of the frame for grasping by the hands of the user. The grips have separable portions to permit the addition or removal of the bands to thereby vary the resistance resulting from the tension of the elastometric material. Each band is an elongated tubular member having opened ends which are joined to form a loop. Each grip is made of three aligned portions that are detachably threaded together. The center portion has threadable opposite end portions that are detachably threadably connected to the other two sections of the grip. A portion of a rod-shaped element is positioned in each open end of the tubular member and an adhesive is applied between the tubular member and the rod-shaped element to secure the ends together.

5 Claims, 5 Drawing Figures

EXERCISING DEVICE HAVING TUBULAR LENGTHS OF STRETCHABLE MATERIAL THE ENDS OF WHICH HAVE CONNECTING MEANS TO FORM THE LENGTHS INTO ENDLESS BANDS

BACKGROUND OF THE INVENTION

This invention relates generally to exercising devices, and more particularly to an exercising device suitable for holding between the hands or between a hand and a foot. As the device is expanded against the resistance resulting from the tension of the resiliant members, various muscles in the arms, chest, back and legs can be toned or built up. The device is capable of a large variety of uses and positions which are well known to persons in the body exercising field.

Stretchable exercising devices of the prior art generally employ a plurality of metallic springs which are connected to each of the hand grips at opposite ends. Devices of this type have numerous drawbacks in that the maximum number of springs which can be employed is limited by initial design to five or six. The springs themselves are heavy to lift and transport and the springs are usually permanently attached to the hand grips decreasing the flexibility of the device. Those devices which employ lengths or bands of elastometric material for the tension members also have the serious drawback in that whenever one of the members breaks, which is frequent, the entire member must be discarded and a new one installed.

In addition, because the tension members of the prior art devices are positioned and held in spaced-apart, parallel relationship to each other, the hand grips cannot be turned relative to each other thus severely limiting the versatility of the device.

SUMMARY OF THE INVENTION

Accordingly, it is an object of the present invention to provide an exercising device which does not have the aforementioned disadvantages of the prior art exercising devices.

It is another object of the present invention to provide an exercising device which is lightweight, of simple construction and is economical to manufacture.

It is yet another object of the present invention to provide an exercising device which employs tubular, elastic bands which can be easily added or removed to regulate the tension of the device.

It is a further object of the present invention to provide an exercising device employing tubular, elastic bands which can easily be mended by means of an adhesive coated rod-shaped member whenever broken.

It is still a further object of the present invention to provide an exercising device employing tubular hand grips that are easily rotatable relative to the frame to which they are attached and which are separable into two parts to enable the elastic bands to be added or removed.

In order to accomplish the aforementioned objects in addition to others which will become readily apparent, the present invention for exercising comprises a pair of substantially U-shaped frame members having rotatable hand grips positioned between the ends of the frame members. The hand grips are separable into two parts to enable one or more bands of tubular, elastometric material to be positioned between the frame members. The tubular bands are initially constructed and can easily be mended by means of an adhesive coated rod-shaped member, a portion of which is inserted into the open ends of tubular members to form the band.

BRIEF DESCRIPTION OF THE DRAWING

The present invention comprises an arrangement of parts hereinafter described and illustrated in the accompanying drawing of a preferred embodiment in which.

DETAILED DESCRIPTION OF THE PREFERRED EMBODIMENT

Figure 1:
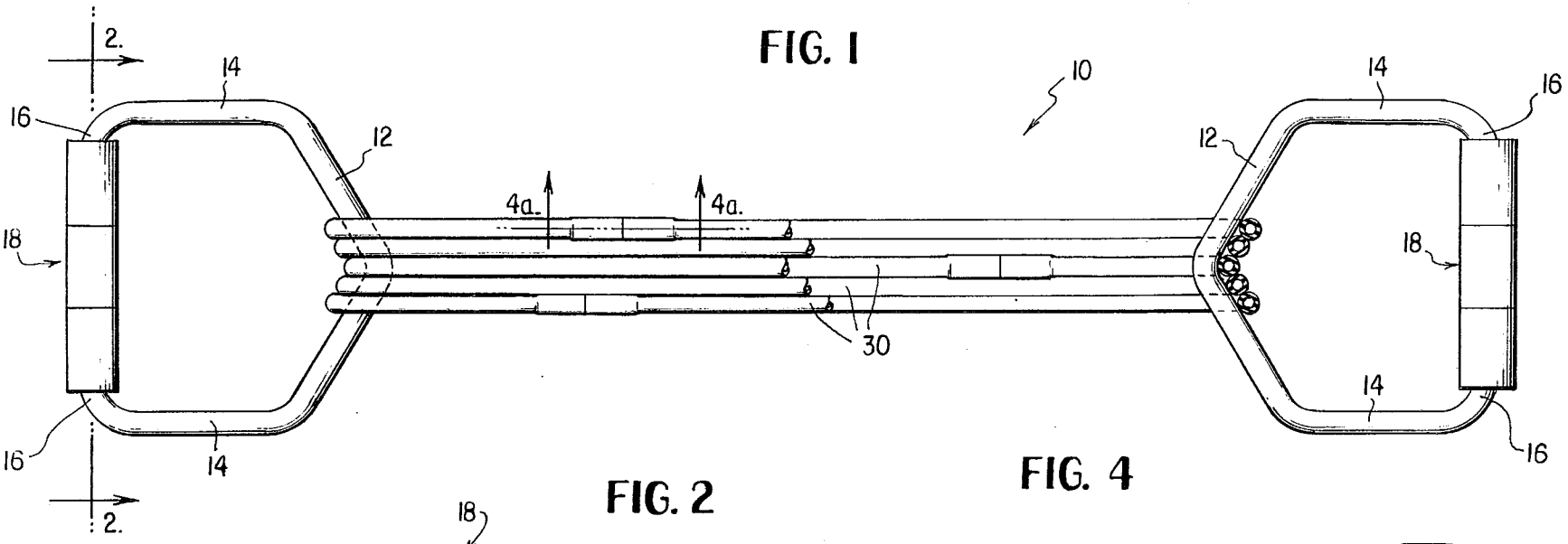
FIG. 1 is a top elevational view of the exercising device in accordance with the present invention.

Referring now to the drawing, throughout which like reference characters designate like parts, the exercising device 10 generally comprises a pair of substantially U-shaped frame members 12. Frame member 12 are preferably made of steel, rod-shaped material and have parallel, spaced-apart side portions 14 which in turn have end portions 16. The end portions 16 are perpendicular to the side portions 14 and are bent inwardly toward each other such that they are in alignment with each other.

Figure 2:
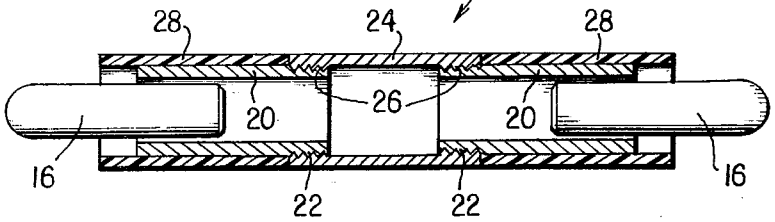
FIG. 2 is a cross-section taken along line 2—2 of FIG. 1.
Figure 3:
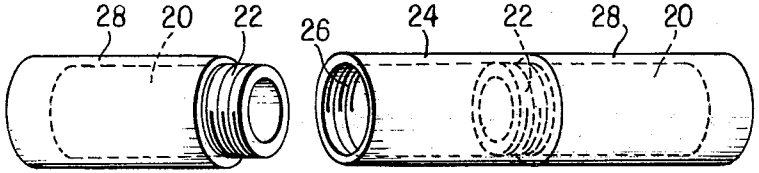
FIG. 3 is a view in perspective of the hand grip of FIGS. 1 and 2 in its separated state.

A pair of hand grips 18 is positioned between end portions 16 on each frame 12. The hand grip 18 is tubular in shape and has an internal diameter substantially larger than the diameter of the frame 12, to thereby permit the grip to rotate freely between the end portions 14 when in use. Ech hand grip 18 is comprised of two tubular, metallic portions 20 which have a threaded, external end 22 as can best see in FIGS. 2 and 3. A tubular metallic portion 24 is also provided having threaded internal ends 26. In its assembled state, one of the externally threaded ends 22 of portion 20 is tightened into one of the internal threaded ends 26 of portion 24 so that it cannot be removed using manual force. Also in its assembled state, the externally threaded end 22 of the remaining portion 20 is loosely tightened into the other internal threaded end 26 of portion 24 so that it can be easily unscrewed manually by the user of the device. A tubular member 28 of plastic-like material is positioned over the tubular members 20 to provide a slightly cushioned gripping surface for the hands of the user.

Figure 4:
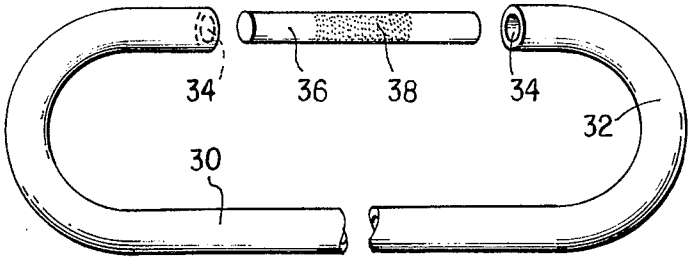
FIG. 4 is a top elevational view of a band and connecting rod of the present invention in their disassembled form.
Figure 4A:
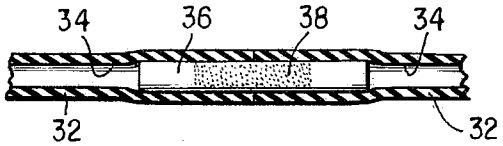
FIG. 4*a* is a sectional view of a band of the present invention in its assembled form with the connecting rod shown in place.

A plurality of bands or loops 30 are positioned between the U-shaped frame members 12. Each loop 30 comprises, as shown in FIG. 4, an elongated tube 32 of hollow, tubular, elastometric material such as pure gum rubber or the like. The open ends 34 of the tube 32 are secured together to form the loop 30 by means of a rod-shaped connecting element 36 approximately one and one-half inches in length and having a diameter substantially equal to that of the inside of the tube 32. The element 36 can be made of, for exapmle, a plastic like material, such as polyvinyl chloride (PVC). A strong adhesive 38 such as an epoxy cement is applied to the outside surface of the connecting element 36 and it is inserted an equal length into the open ends 34 of tube 32. The position of the connecting element 36 can best be seen by referring to FIG. 4*a*. In the event that one of the loops should break during use, all that is necessary is that the aforementioned assembly procedure be repeated using an additional element 36, a new tube 32 is not required.

In order to add or remove assembled loops 30 to vary the degree of tension or force resistance of the device 10, all that is necessary is that the loosely tightened tubular portions 20, 24 be unscrewed from each other on each grip 18 and the loop 30 passed therebetween. Upon reassembly of the portions 20,24, the device is again ready for use.

Having illustrated and described embodiments of this invention in some detail, it will be understood that these descriptions and illustrations have been offered by way of example, and that the invention is to be limited only by the appended claims.

What is claimed is:

1. An exercising device comprising:

a. first and second substantially U-shaped frame members, each of said frame members having two parallel side portions, each of said side portions having an end portion formed inwardly thereof such that the end portions of each side portion is axially aligned with and spaced from the other;

b. at least one length of elastometric material being looped between said first and second frame member, said length having ends secured together by means to form an endless band; and c. a tubular grip member rotatably mounted on said axially aligned end portions of each of said side portions of said first and second frame members, each of said grip members having a center portion having threads at its respective ends, first and second tubular sections with a threaded means detachably threaded to the center portion at the latter's respective ends, so that said first and second sections may move axially relative to said axially aligned end portions without and permit the detachment of said center portion altering said parallel relationship.

2. An exercising device is set forth in claim 1 wherein a substantial portion of said grip member is covered with a plastic material.

3. An exercising device as set forth in claim 1 wherein said endless bands are tubular.

4. An exercising device as set forth in claim 3 wherein said endless bands further comprise:

a. a length of tubular material having two open ends;

b. a rod-shaped element, a portion of said element being insertable into each of said open ends such that said ends abut each other; and c. an adhesive material between said tubular material and said element to secure said tubular material to said element to form said endless loop.

5. An exercise device as set forth in claim 4 wherein said tubular material is rubber.

* * * * *